US006907957B1

(12) United States Patent
Couch

(10) Patent No.: US 6,907,957 B1
(45) Date of Patent: Jun. 21, 2005

(54) TRENCH SHIELD LADDER

(76) Inventor: Arthur Allen Couch, 4834 S. Knoxville, Tulsa, OK (US) 74135

( * ) Notice: Subject to any disclaimer, the term of this patent is extended or adjusted under 35 U.S.C. 154(b) by 68 days.

(21) Appl. No.: 10/724,916

(22) Filed: Dec. 1, 2003

Related U.S. Application Data

(63) Continuation-in-part of application No. 10/179,781, filed on Jun. 25, 2002, now abandoned.

(51) Int. Cl.[7] ..... E06C 1/36; E06C 7/18; E04G 3/00; E02D 17/00

(52) U.S. Cl. ..... 182/206; 182/83; 182/106; 405/283

(58) Field of Search ..... 182/206, 106, 182/194, 129, 83; 405/272, 273, 282, 283

(56) References Cited

U.S. PATENT DOCUMENTS 3,029,607 A * 4/1962 Millerbernd ..... 405/283
3,591,123 A * 7/1971 Edwards ..... 405/272
3,727,413 A * 4/1973 Christen ..... 405/282
3,766,740 A * 10/1973 Teegen ..... 405/282
3,922,866 A * 12/1975 Benning ..... 405/283
5,195,849 A * 3/1993 Stapleton ..... 405/282
5,527,137 A * 6/1996 Spencer ..... 405/283
6,155,750 A * 12/2000 Wu et al. ..... 405/283
6,224,296 B1 * 5/2001 Fukumori ..... 405/282
6,443,665 B1 * 9/2002 Kundel, Sr. ..... 405/283

FOREIGN PATENT DOCUMENTS

FR 2615218 A1 * 11/1988 ..... E02D 17/08

* cited by examiner

*Primary Examiner*—Hugh B. Thompson II
(74) *Attorney, Agent, or Firm*—Molly D. McKay

(57) ABSTRACT

A trench shield ladder that hangs on the wall of the trench shield to provide workmen safe access to a trench. The ladder is provided with a top platform and hand rails that extend over the platform. The ladder can be adjusted in length by employing an extension portion with hooks that hang the extension on the main rungs of the main ladder. The extension portion is not as wide as the main portion of the ladder so that the legs of the extension rest between the legs of the main portion of the ladder. The ladder and extension are provided with stand off arms that hold the main and extension rungs of the ladder away from the wall of the trench shield. The present invention is designed to fit on trench shields of varying thicknesses.

11 Claims, 5 Drawing Sheets

TRENCH SHIELD LADDER

This application is a continuation-in-part of application Ser. No. 10/179,781 filed Jun. 25, 2002, now abandoned.

BACKGROUND OF THE INVENTION

1. Field of the Invention

The present invention relates to a ladder for use with a trench shield to allow the user to climb down the ladder into a trench located within the walls of the trench shield. More specifically, the present invention is a ladder that is movable with the trench shield when the trench shield is pulled through a trench and can be lengthened with an extension so that the ladder is of the desired length when trench shields are stacked on top of each other for use in deep trenches. The present ladder meets applicable safety standards, and usage of this ladder can prevent injuries that often occur when using other types of ladders in this type of service.

2. Description of the Related Art

When workmen need to work in a trench in the ground, such has for example when laying cable or pipe or when doing repair work on underground lines, a trench shield is employed to prevent the sides of the trench from caving in and burying the workmen. Trench shields are made of two parallel walls that are held approximately 3 feet or more apart so that the workmen can work between the walls. The walls are approximately 8 feet tall and are strong enough to shield the workmen from a possible collapse of the trench walls. The walls are also several feet in length. The most common lengths are 8, 12, 16, 20 and 24 feet.

Currently, in order for workmen to climb down the walls of the trench shield to enter the trench, they must climb down a traditional straight ladder that has been placed into the trench between the walls of the trench shield. Use of a traditional straight ladder presents several safety problems. First, if the trench is deep, often a pair of trench shields will be employed so that one trench shield is stacked on top of the other one. Often a straight ladder is not long enough to safely use in these deep trenches.

Second, in order to use a straight ladder, safety regulations require that the ladder be tied off so that it does not tip when the workmen are on the ladder and does not fall in on top of them when they are in the trench.

As work is completed in one section of the trench, it is normally necessary to move the trench shield to another section of the trench by dragging it through the trench. When a traditional straight ladder is employed with a trench shield, the lower end of the ladder rests on the bottom of the trench. In order to safely move the trench shield along the trench, the ladder must first be untied from the trench shield and then pulled out of the trench shield. Then it is safe to pull the trench shield through the trench to its new location. After the trench shield has been moved, the straight ladder is then reinserted between the trench shield walls and is again tied off. This is a time consuming procedure and workmen will often become lazy and not take the time to perform this procedure in a safe manner. For example, they may instead push the straight ladder out the back end of the trench shield so that the trench shield can be moved without removing the ladder from the trench. If they are in the trench when they push the ladder outside of the trench shield, they often place themselves at risk because once they are beyond the walls of the trench shield, they are no longer protected from falling debris and a possible cave in of the sides of the trench. Also, once the ladder is placed outside the walls of the trench shield, workmen will often use the ladder in that unprotected location rather than take the time to reposition the ladder within the trench shield and properly tying the ladder to the trench shield. Workmen have been injured and killed by falling rocks and trench cave ins while they were in a trench but outside the protective walls of the trench shield.

The present invention addresses these problems by providing a ladder that can be extended to the desired length to permit safe access to any depth of trench shield and trench. The present invention also rests on the upper lip of the trench shield instead of the bottom of the trench and therefore can be moved with the trench shield. The present ladder fits securely over the upper lip of the trench shield and is held in place by gravity so that it is not necessary to tie the ladder to the trench shield to insure that the ladder is stable and does not fall sideways or drop off of the upper lip of the trench shield. Further, the present invention is provided with a safety platform at the top of the ladder and rails that extend over the top of the ladder to make it safe and easy for the workmen to climb into and out of the trench. Still further, the present invention is provided with stand off arms so that the workmen can fully engage the main and extension rungs of the ladder with their feet along the entire length of the ladder. The present invention is designed to fit on trench shields of varying thicknesses, easily fitting on the common trench thicknesses of approximately 4 inches and approximately 8 inches.

SUMMARY OF THE INVENTION

The present invention is a trench shield ladder that attaches to the top lip of a trench shield and hangs on the wall of the trench shield to provide workmen safe access to the trench. Because the ladder hangs on the wall of the trench shield, it is moved with the trench shield as the trench shield is pulled through the trench. Also, because the ladder fits securely over the upper lip of the trench shield and is held in place by gravity, it is not necessary to tie the ladder to the trench shield to insure that the ladder is stable and does not fall sideways or drop off of the upper lip of the trench shield.

Still further, the present invention is provided with stand off arms so that the workmen can fully engage the main and extension rungs of the ladder with their feet along the entire length of the ladder. The present invention is designed to fit on trench shields of varying thicknesses, easily fitting on the common trench thicknesses of approximately 4 inches and approximately 8 inches.

Further, the present invention is provided with a safety platform at the top of the ladder and hand rails that extend approximately 36 inches over the platform of the ladder to make it safe and easy for the workmen to climb into and out of the trench.

The ladder can be extended to the desired length to permit safe access to various depths of trench and various heights of trench shield and by use of an extension portion of the ladder. The extension portion is provided with hooks on the upper end of the legs of the extension portion so that the hooks can be looped over any of one the main rungs of the ladder to thereby allow the ladder to be extended to any length desired. The extension portion is not as wide as the main portion of the ladder so that the legs of the extension rest between the legs of the main portion of the ladder when the extension portion is in use. The extension portion hangs from the main portion of the ladder via gravity and is provided with stand off arms similar to the stand off arms provided on the main portion of the ladder.

DETAILED DESCRIPTION OF THE PREFERRED EMBODIMENT THE INVENTION

Figure 1:
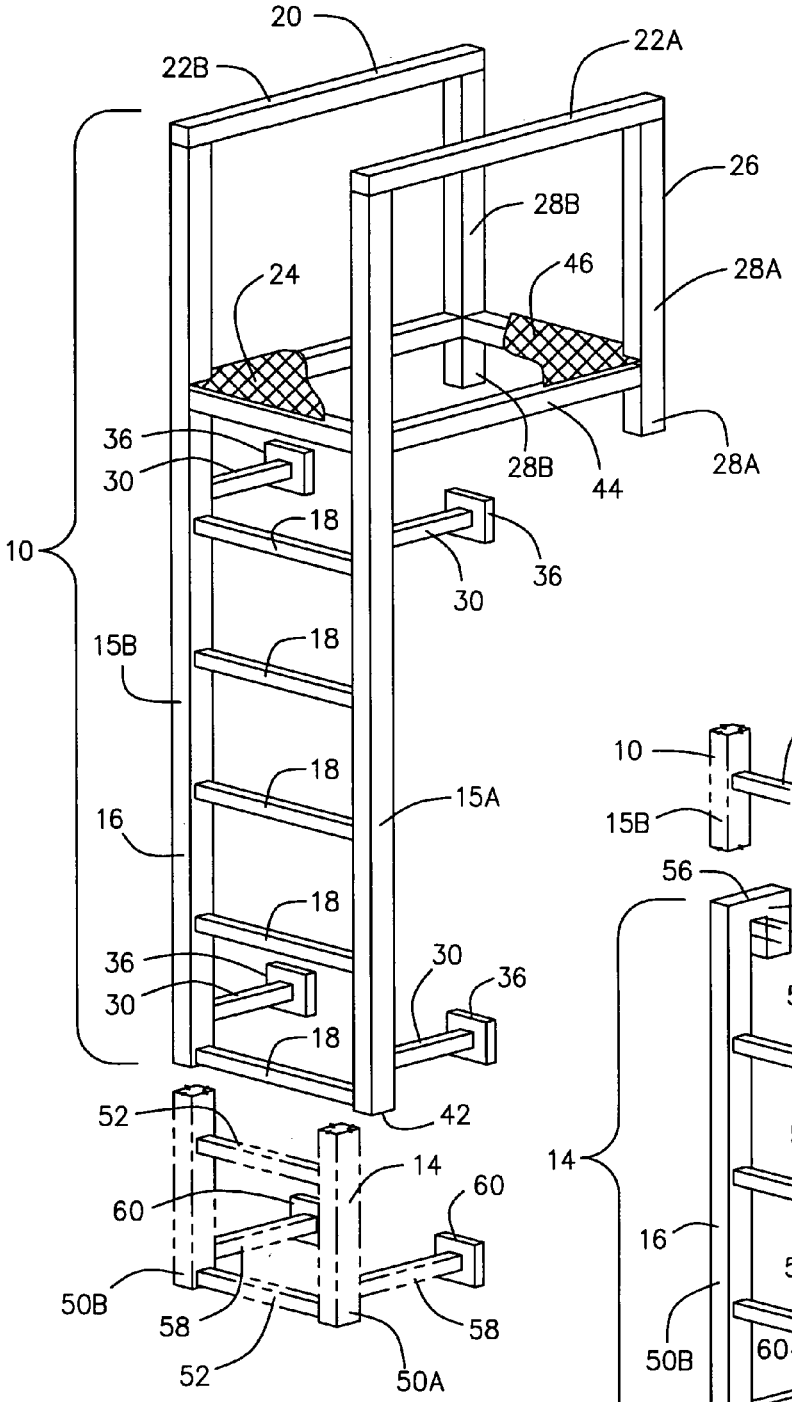
FIG. 1 is a perspective view of a trench shield ladder constructed in accordance with a preferred embodiment of the present invention with the location of an extension portion shown in outline and with a portion of the top platform cut away to reveal the supporting framework.
Figure 2:
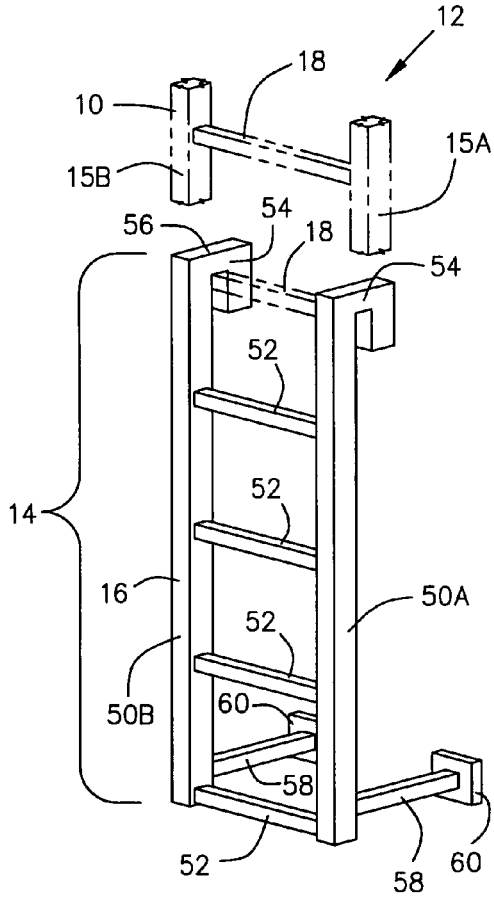
FIG. 2 is a perspective view of the extension portion of FIG. 1, shown with the main portion of the trench shield ladder shown partially cut away in outline.
Figure 5:
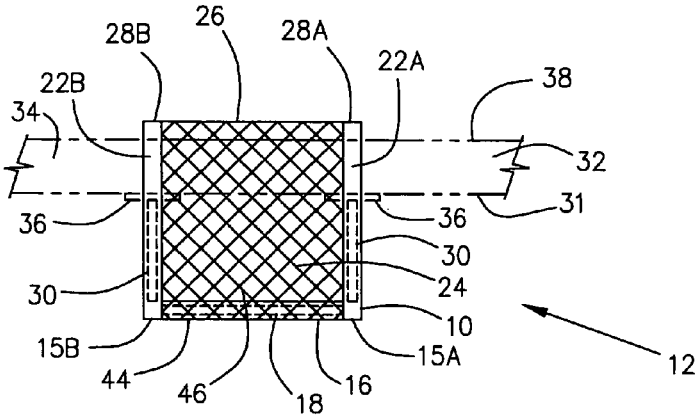
FIG. 5 is a top plan view of the trench shield ladder of FIGS. 3 and 4.
Figure 8:
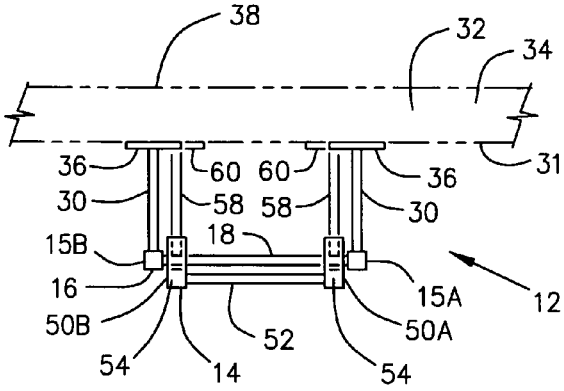
FIG. 8 is a top view of the lower end of the trench shield ladder and extension portion taken along line 8—8 of FIG. 6.
Figure 6:
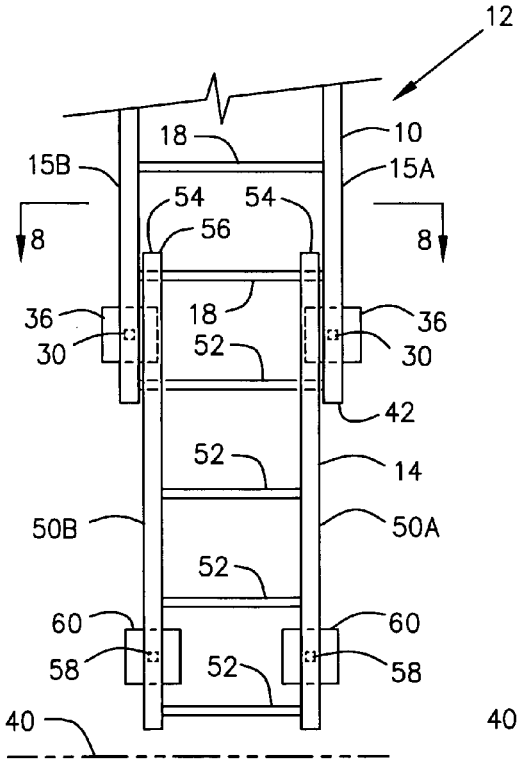
FIG. 6 is a front elevation of the lower end of the trench shield ladder showing the extension portion in use.
Figure 7:
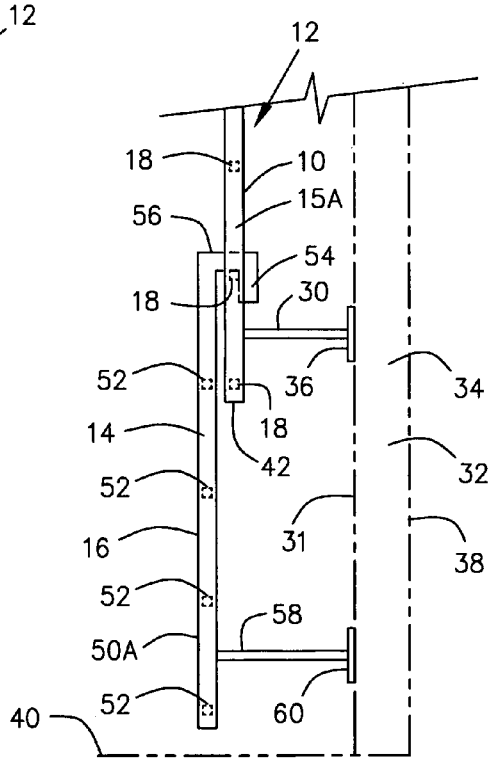
FIG. 7 is a side view of the lower end of the trench shield ladder and extension portion of FIG. 6.

Referring now to the drawings and initially to FIG. 1 and FIGS. 3–5, there is illustrated a main portion 10 of a trench shield ladder 12 that is constructed in accordance with a preferred embodiment of the present invention. This trench shield ladder 12 can be extended in length by employing an extension portion 14, as shown in outline in FIG. 1. FIG. 2 illustrates the extension portion 14 and shows the main portion 10 of the trench shield ladder 12 in outline. Both the main portion 10 of the ladder 12 and the attached extension portion 14 are illustrated in FIGS. 6–8.

As illustrated in FIGS. 1 and 3–5, the main portion 10 of the ladder 12 is provided with two front legs 15A and 15B that extend vertically downward approximately parallel to each other on a front side 16 of the ladder 12. Spaced apart ladder main rungs 18 are provided extending approximately horizontally between the two legs 15A and 15B on the front side 16 of the ladder 12. The two legs 15A and 15B continue at the top end 20 of the ladder 12 as a pair of inverted u-shaped hand rails 22A and 22B that extend over a top platform 24 of the ladder 12 and terminate on a back side 26 of the ladder 12 as two rear legs 28A and 28B that extend vertically downward approximately parallel to each other and approximately parallel with the two front legs 15A and 15B.

Stand off arms 30 for removably engaging an inwardly facing surface 31 of a wall 32 of a trench shield 34 are provided on the two front legs 15A and 15B so that the stand off arms 30 extend rearward from the front legs 15A and 15B and are approximately perpendicular to the front legs 15A and 15B. A foot 36 is provided on a distal end 38 of each stand off arm 30 for engaging the inwardly facing surface 31 of the wall 32 of the trench shield 34 when the ladder 12 is in use. The stand off arms 30 hold the front legs 15A and 15B of the ladder 12 away from the wall 32 of the trench shield 34 so that the workmen can fully engage the main rungs 18 of the ladder 12 with their feet along the entire length of the ladder 12 as they ascend and descend the ladder 12.

When in use, the rear legs 28A and 28B of the ladder 12 extend on the outside of the trench shield 34 and engage an outwardly facing surface 38 of the trench shield wall 32, and the front legs 15A and 15B extend into a trench 40 adjacent the inwardly facing surface 31 of the wall 32 of the trench shield 34 so that the feet 36 of the stand off arms 30 contact the inwardly facing surface 31 of the wall 32 at least at a lower end 42 of the main portion 10 of the ladder 12. The stand off arms 30 and the rear legs 28A and 28B are separated a sufficient distance so that the ladder 12 can be employed with trench shields 34 having walls 32 of various thicknesses, with thicknesses of 4 inches and 8 inches being the most common thicknesses currently employed.

Although the drawings illustrate that the ladder 12 hangs on the wall 32 of the trench shield 34 so that all of the feet 36 of the stand off arms 30 engage the inwardly facing surface 31 of the wall 32 of the trench shield 34, i.e. both at the top and lower ends 20 and 42 of the main portion 10 of the ladder 12, this is only possible when the wall 32 of trench shield 34 is at the higher end of the range of thicknesses accommodated by the ladder 12. For trench shield walls 32 of lesser thicknesses, the feet 36 on the top end 20 of the ladder 12 will not engage the inwardly facing surface 31 of the wall 32 of the trench shield 34, but the feet 36 on the lower end 42 will engage the inwardly facing surface 31 of the wall 32 and the rear arms 28A and 28B will engage the outwardly facing surface 38 of the wall 32 on the other side of the same wall 32 to hold the ladder 12 stable as the ladder 12 hangs on the wall 32.

Because the ladder 12 hangs over the wall 32 of the trench shield 34, it is moved with the trench shield 34 as the trench shield 34 is pulled longitudinally through the trench 40. Also, because the ladder 12 fits securely over the wall 32 of the trench shield 34 and is held in place by gravity, it is not necessary to tie the ladder 12 to the trench shield 34 in order to insure that the ladder 12 remains stable and does not fall sideways or drop off of the wall 32 of the trench shield 34.

The top platform 24 is supported by a frame 44 that extends between the two front legs 15A and 15B, between the two rear legs 28A and 28B and between the front and rear legs, i.e. between legs 15A and 28A and between legs 15B and 28B. The platform 24 has a cover 46 that can safely hold the weight of a workman as the workman steps onto the platform 24 while entering and leaving the trench 40 via the ladder 12. Each of the inverted unshaped hand rails 22A and 22B is preferably approximately 36 inches in height so that they provide a safe handhold for workmen as the workmen descend and ascend the ladder 12.

Figure 3:
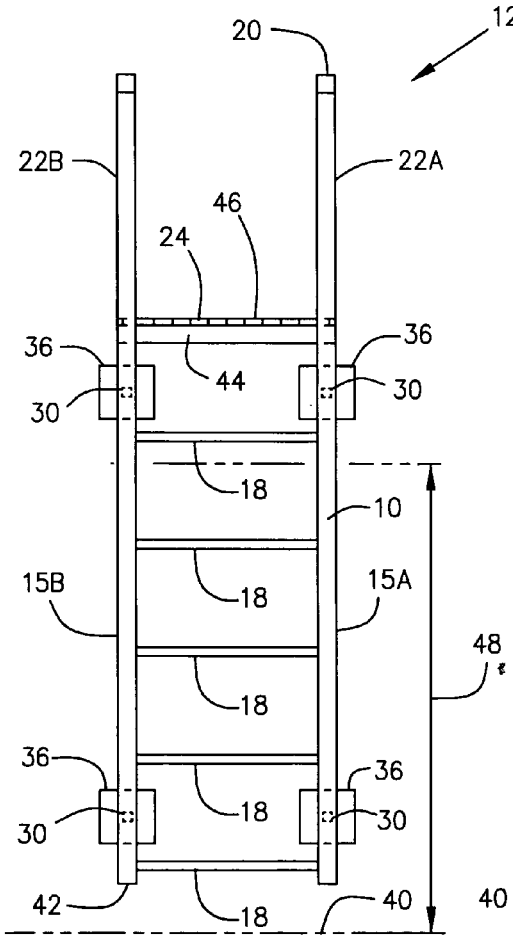
FIG. 3 is a front elevation of the trench shield ladder of FIG. 1 shown attached to a wall of a trench shield.
Figure 4:
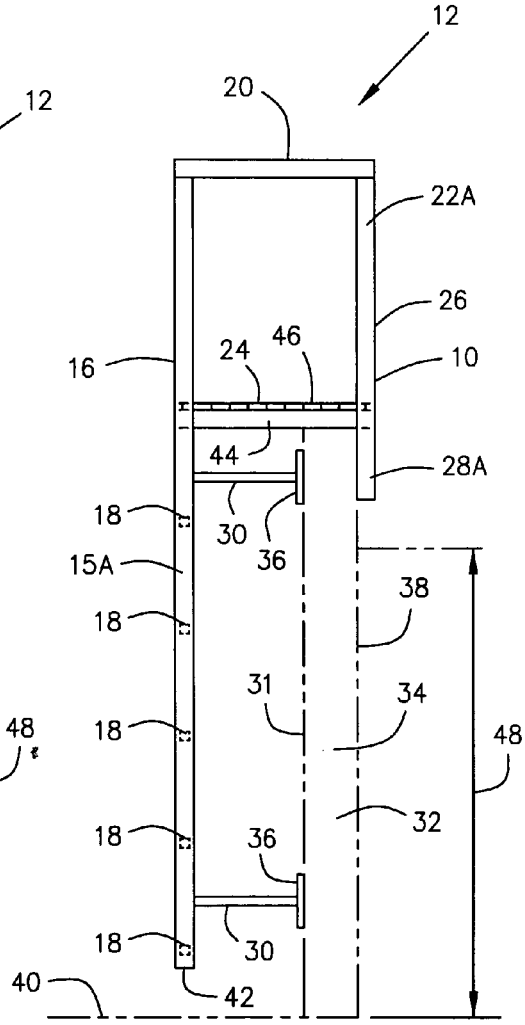
FIG. 4 is a side view of the trench shield ladder of FIG. 3.

The ladder 12 may be used with only the main portion 10 attached to the wall 32, or alternately, with the main portion 10 attached to the wall 32 and the extension portion 14 attached to the main portion 10, depending on the depth 48 of the trench 40. The depth 48 of the trench 40 is illustrated in FIGS. 3 and 4. Obviously, the depth 48 of the trench 40 will also dictate the total height of the trench shield 34, or alternately, the total height of a pair of stacked trench shields 34 with which the ladder 12 is employed.

Referring now to FIGS. 2, and 6–7, the extension portion 14 of the ladder 12 will be described. The ladder 12 can be extended to the desired length to permit safe access to various depths 48 of trenches and various heights of trench shields by use of the extension portion 14 of the ladder 12. The extension portion 14 is provided with two approximately vertical and approximately parallel extension legs 50A and 50B and with spaced apart extension rungs 52 extending approximately horizontally between the two extension legs 50A and 50B.

Each of the extension legs 50A and 50B is provided with an inverted u-shaped hook 54 on the upper end 56 of the extension legs 50A and 50B so that the hooks 54 can be looped over any one of the main rungs 18 of the main portion 10 of the ladder 12 to thereby hang the extension portion 14 onto the ladder 12 onto the main portion 10, and thereby allowing the ladder 12 to be extended to any total length desired. The extension portion 14 is not as wide as the main portion 10 of the ladder 12 so that the extension legs 50A and 50B hang between the front legs 15A and 15B of the main portion 10 of the ladder 12 when the extension portion 14 is in use. The extension portion 14 hangs from the main portion 10 of the ladder 12 via gravity and is provided with stand off arms 58 and associated feet 60 that are similar in structure and function to the stand off arms 30 and feet 36 provided on the main portion 10 of the ladder 12.

Combination Ladder and Trench Shield

Figure 9:
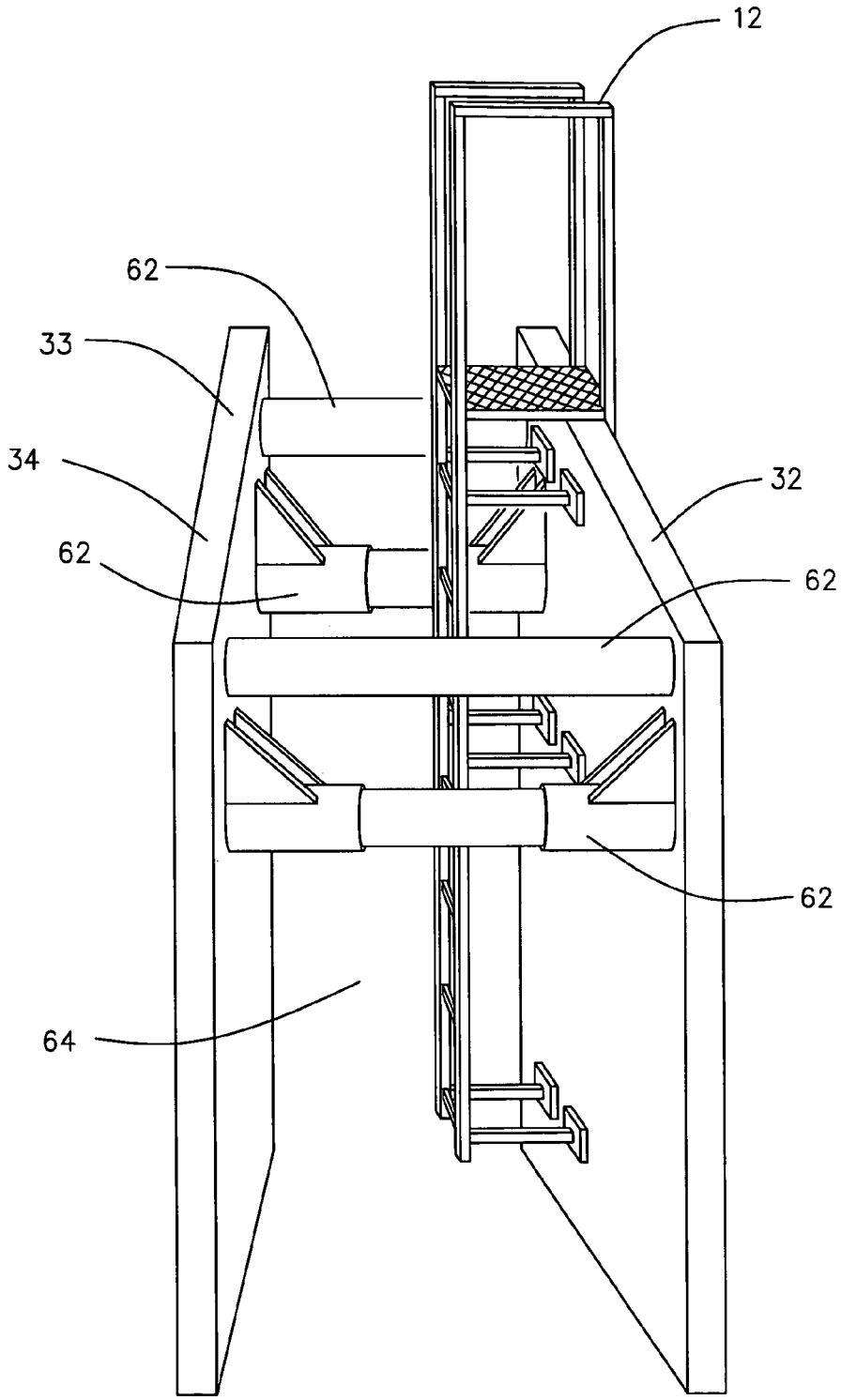
FIG. 9 is a perspective view of the trench shield ladder in combination with a trench shield.
Figure 10:
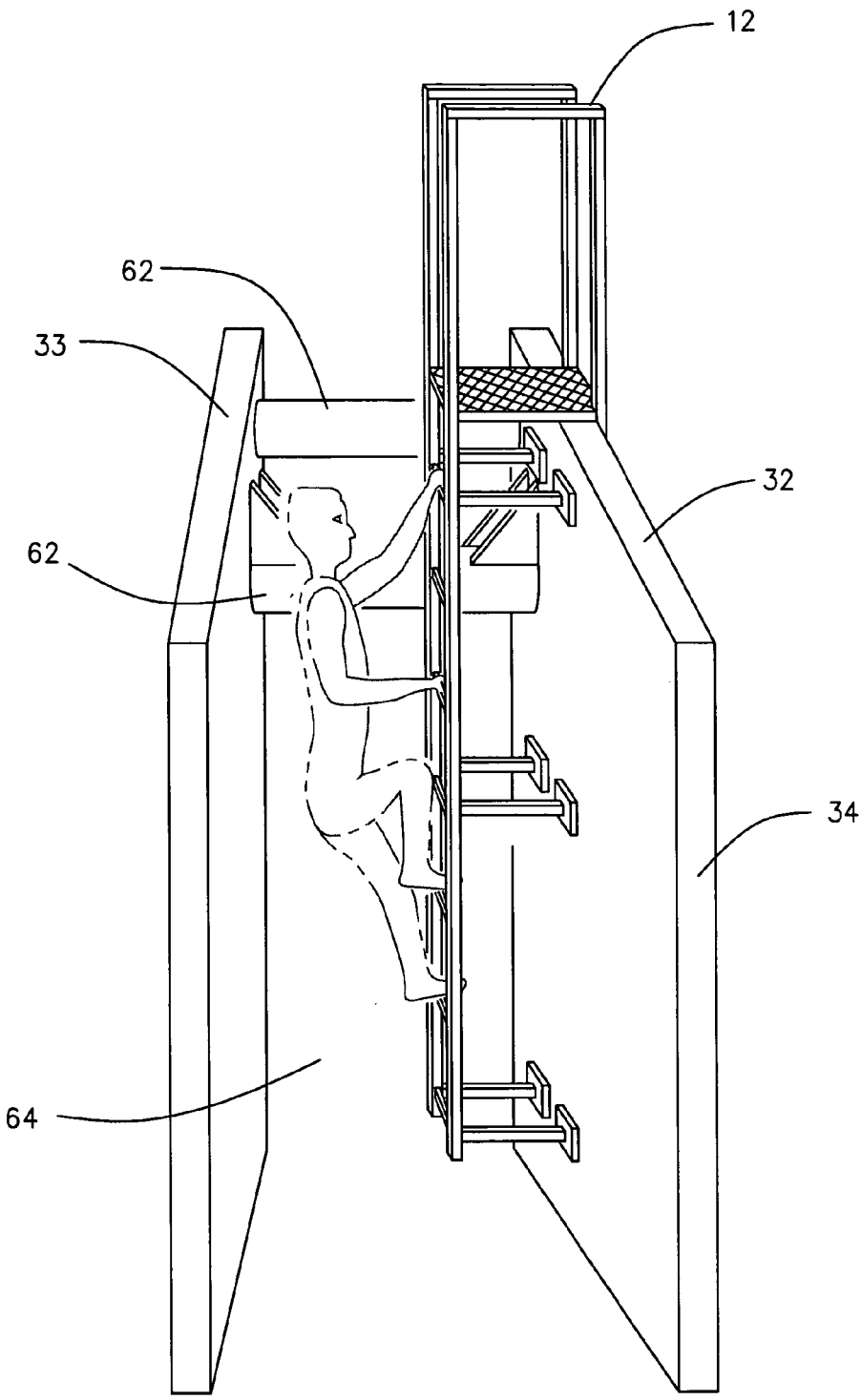
FIG. 10 is a side view of the trench shield ladder in combination with the trench shield of FIG. 9.

Referring to FIGS. 9 and 10, there is shown the trench shield ladder 12 in combination with the trench shield 34 with which it is employed. The trench shield 34 is provided with two spaced apart planar panels or walls 32 and 33 that are approximately parallel with each other. The trench shield 32 is provided with a plurality of support rods 62 extending between and secured to the two walls 32 and 33. The support rods 62 serve to hold the walls 32 and 33 apart so that a working space 64 is provided between the planar walls 32 and 33. The purpose of the trench shield 34 is to provide a safe environment for workmen who must work in a trench in the ground. By placing the trench shield 34 into the trench, the walls 32 and 33 serve to prevent the sides of the trench from caving in on the workmen as they are working in the bottom of the trench.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A trench shield ladder in combination with a trench shield comprising:

two spaced apart trench shield walls, a plurality of support rods attaching between the two spaced apart trench shield walls to hold them apart and forming a working space between the two trench shield walls, two approximately parallel front legs for removably engaging an inwardly facing surface of a first trench shield wall, spaced apart main rungs extending between the two legs, a top platform attached approximately perpendicular to upper ends of said legs for engaging said first trench shield wall, hand rails extending over the platform, at least one rear leg attached approximately perpendicular to said top platform and approximately parallel to said front legs for engaging an opposite outwardly facing surface of said first trench shield wall, said hand rails being continuous with both said front and said rear legs, and each of said front legs and each of said rear legs being rigidly secured relative to said platform.

2. The trench shield ladder in combination with a trench shield according to claim 1 further comprising:

stand off arms provided on the front legs to removably engage an inwardly facing surface of said first trench shield wall to hold the main rungs of the ladder away from the first trench shield wall while still allowing the ladder to be moved relative to the first trench shield wall.

3. The trench shield ladder in combination with a trench shield according to claim 1 wherein the front legs are spaced apart from said at least one rear leg a sufficient distance to allow the front and rear legs to receive trench shield walls of varying thicknesses.

4. The trench shield ladder in combination with a trench shield according to claim 1 further comprising:

an extension portion removably added to the bottom of the front legs, said extension portion having two extension legs with hooks at the upper end of each extension leg for removably hanging the extension portion on the main rungs, and spaced apart extension rungs extending between the extension legs.

5. The trench shield ladder in combination with a trench shield according to claim 4 further comprising:

stand off arms provided on the extension legs to removably engage an inwardly facing surface of the first trench shield wall to hold the extension rungs away from the first trench shield wall while still allowing the ladder to be moved relative to the first trench shield wall.

6. A trench shield ladder in combination with a trench shield comprising:

two spaced apart trench shield walls, a plurality of support rods attaching between the two spaced apart trench shield walls to hold them apart and forming a working space between the two trench shield walls, a front ladder with two front legs, spaced apart main rungs extending approximately perpendicular to and between said front legs, a top platform attached approximately perpendicular to said front ladder at an upper end of said front ladder, and at least one rear leg attached approximately perpendicular to said top platform and approximately parallel to said front legs and spaced apart from said front legs, hand rails being continuous with both said front and said rear legs, and each of said front legs and each of said rear legs being rigidly secured relative to said platform.

7. The trench shield ladder in combination with a trench shield according to claim 6 further comprising:

at least one hand rail attached to said platform and extending over the platform.

8. The trench shield ladder in combination with a trench shield according to claim 6 further comprising:

stand off arms provided on the front legs and extending toward the at least one rear leg to removably engage an inwardly facing surface of a first trench shield wall in order to hold the main rungs of the front ladder away from the first trench shield wall while still allowing the ladder to be moved relative to the first trench shield wall.

9. The trench shield ladder in combination with a trench shield according to claim 6 wherein the front legs are spaced apart from said at least one rear leg a sufficient distance to allow trench shield walls of varying thicknesses to be removably inserted between the front and rear legs.

10. The trench shield ladder in combination with a trench shield according to claim 6 further comprising:

an extension portion removably added to the bottom of the front legs, said extension portion having two extension legs with hooks at the upper end of each extension leg for removably hanging the extension portion on the main rungs, spaced apart extension rungs extending between the extension legs.

11. The trench shield ladder in combination with a trench shield according to claim 10 further comprising:

rearwardly extending stand off arms provided on the front legs and the extension legs to removably engage an inwardly facing surface of the first trench shield wall in order to hold the main rungs and the extension rungs away from the first trench shield wall while still allowing the ladder to be moved relative to the first trench shield wall.

* * * * *